United States Patent [19]

Marr, Jr.

[11] 4,303,128

[45] Dec. 1, 1981

[54] INJECTION WELL WITH HIGH-PRESSURE, HIGH-TEMPERATURE IN SITU DOWN-HOLE STEAM FORMATION

[76] Inventor: Andrew W. Marr, Jr., P.O. Box 1464, Ardmore, Okla. 73401

[21] Appl. No.: 100,704

[22] Filed: Dec. 4, 1979

[51] Int. Cl.[3] ..... E21B 43/24

[52] U.S. Cl. ..... 166/302; 166/60; 166/65 R; 166/113; 166/272

[58] Field of Search ..... 166/60, 248, 65 R, 302, 166/303, 272, 113

[56] References Cited

U.S. PATENT DOCUMENTS

| | | | |
|---|---|---|---|
| 2,350,429 | 6/1944 | Troupe | 166/60 |
| 2,801,090 | 7/1957 | Hoyer et al. | 166/60 X |
| 3,507,330 | 4/1970 | Gill | 166/60 X |
| 3,547,193 | 12/1970 | Gill | 166/248 |
| 3,605,888 | 9/1971 | Crowson et al. | 166/60 X |
| 4,037,655 | 7/1977 | Carpenter | 166/248 |
| 4,185,691 | 1/1980 | Tubin et al. | 166/60 X |

*Primary Examiner*—Stephen J. Novosad

*Attorney, Agent, or Firm*—Berman, Aisenberg & Platt

[57] ABSTRACT

A portion of an injection well adjacent an oil-bearing earth formation is sealed off by spaced-apart high-pressure-resistant plugs, and water is charged into the borehole space between the plugs at a sufficient rate to effect sustained water pressure in the range of from 400 to 25,000 psi. Under such pressure sufficient current is passed between two electrodes in the water to convert from 10 to 33 barrels of water per hour into steam.

37 Claims, 5 Drawing Figures

INJECTION WELL WITH HIGH-PRESSURE, HIGH-TEMPERATURE IN SITU DOWN-HOLE STEAM FORMATION

THE TECHNICAL FIELD

A secondary-oil recovery method stimulates flow of oil from a pay zone in a formation traversed by a bore hole by converting liquid water in the bore hole and adjacent the pay zone into steam in situ.

BACKGROUND ART

Crowson (U.S. Pat. No. 3,605,888) considers a method for secondary recovery of oil in which electrical current is caused to flow through water in the bottom of a bore hole to produce heating of the water. In one embodiment the water is contained within a reservoir until the temperature of the water is sufficiently high to produce steam at the pressure present in the oil-bearing strata. The water and steam are then released from the reservoir into the strata.

Hendrick (U.S. Pat. No. 3,954,140) contemplates having heating elements at different bore hole levels to heat adjacent hydrocarbon-containing formations to a predetermined level in excess of about 600° F., e.g., about 575° to 725° F. for a typical oil shale formation, thus producing hot hydrocarbon gases which are driven from the heated portions of the formation and passed through porous casing before being drawn through a suction line to a fractionator. Thereafter, temperature in lower bore hole levels is increased to a higher temperature, e.g. about 1200° F. for a typical oil-shale formation, and the process is continued until each higher bore hole level is heated to the higher temperature.

Carpenter (U.S. Pat. No. 4,037,655) connects a plurality of electrodes in contact with salt water and oil in a subterranean formation to a source of electrical power for establishing an AC electrical field of current flow between the spaced electrodes. The AC electrical current path through the formation generates volumes of free hydrocarbon in the formation where it is trapped for increasing the formation pressure. The increased pressure of the formation drives the oil into producing bore holes spaced from the electrode bore holes. Carpenter (paragraph bridging columns 1 and 2) cites prior-art patents related to introducing electrical current into a subsurface oil- or mineral-bearing formation for the express purpose of heating the formation in order to lower viscosity and stimulate flow of oil or minerals in the immediate area involved in the heating process.

Tubin (U.S. Pat. No. 4,127,169) stimulates the flow of oil in the formation traversed by a bore hole to cause migration of the oil into the bore hole where it is recoverable to the surface by conventional techniques. He generates steam in situ within the bore hole from surface-supplied water in heat-transfer proximity to the pay zone of said formation.

He injects thermal energy directly into the pay zone at a preselected depth and at a temperature usually ranging from 250° to 450° F. Cold water is pumped down a string of tubing into a tool where it is converted into steam, and thus-generated steam is forced out into the formation.

STATEMENT OF THE INVENTION

Many problems are encountered in the secondary recovery of oil from subterranean formations in which it exists. A number of these problems are reviewed in the previously-cited patents. The problem encountered in the transmission of steam from the surface to the proximity of the pay zone is solved by producing steam in situ adjacent the pay zone in a bore hole. The in situ production of steam is enhanced by starting with hot water. Having water at the proximity of the pay zone under high pressure makes it possible to produce high temperatures in the pay zone. By transforming large quantities of high-pressure water into steam, the resultant pressure and temperature has a greatly-enhanced effect of driving subterranean oil into bore holes from which it is recoverable.

The invention contemplates setting off a selected volume of a bore hole adjacent an oil-bearing earth formation and having the bore-hole casing perforate over this portion of the bore hole. Hot water, e.g. at about 200° F. (93.3° C.), is charged into that portion of the bore hole at a rate within the approximate range of from 25 to 45 barrels per hour under a pressure from 400 psi to 25,000 psi (28 $Kg/cm^2$ to 1750 $Kg/cm^2$), depending upon formation porosity. By passing sufficient current through the water between two electrodes in the bore hole, the water is heated in situ to temperatures close to or exceeding 700° F. (371° C.) From 10 to 33 barrels of water per hour are vaporized in situ.

BRIEF DESCRIPTION OF THE FIGURES OF DRAWING

DETAILED DESCRIPTION

Figure 2:
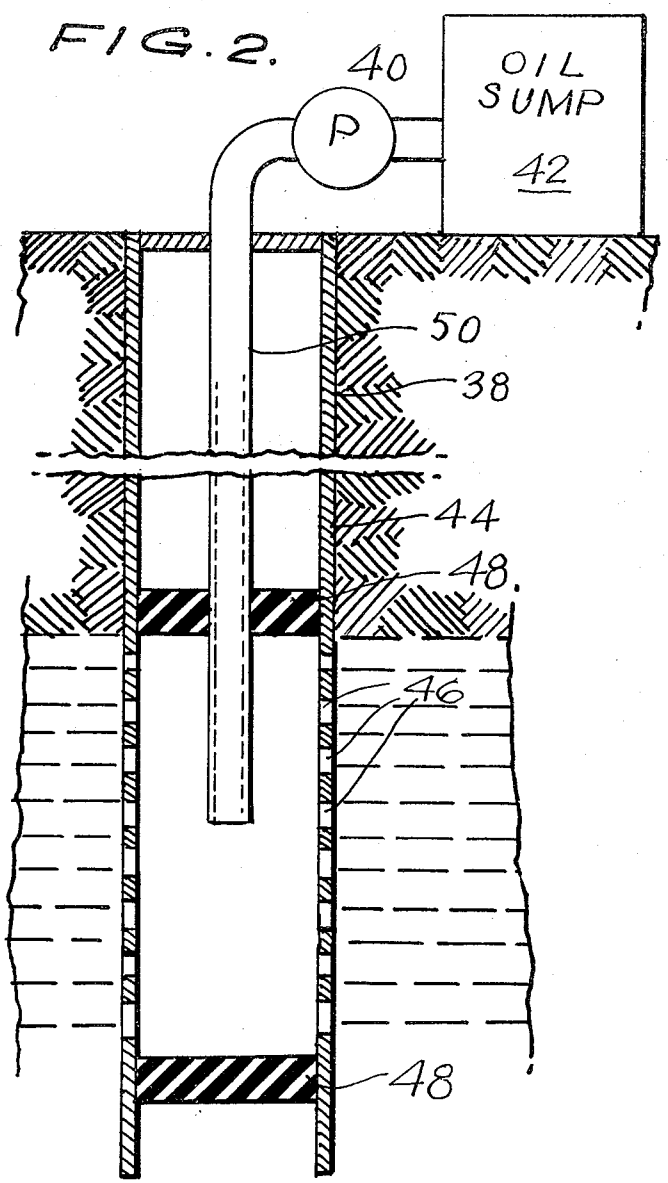
FIG. 2 is a schematic partially-cross sectional view of an oil-recovery well used in conjunction with an injection well.
Figure 1:
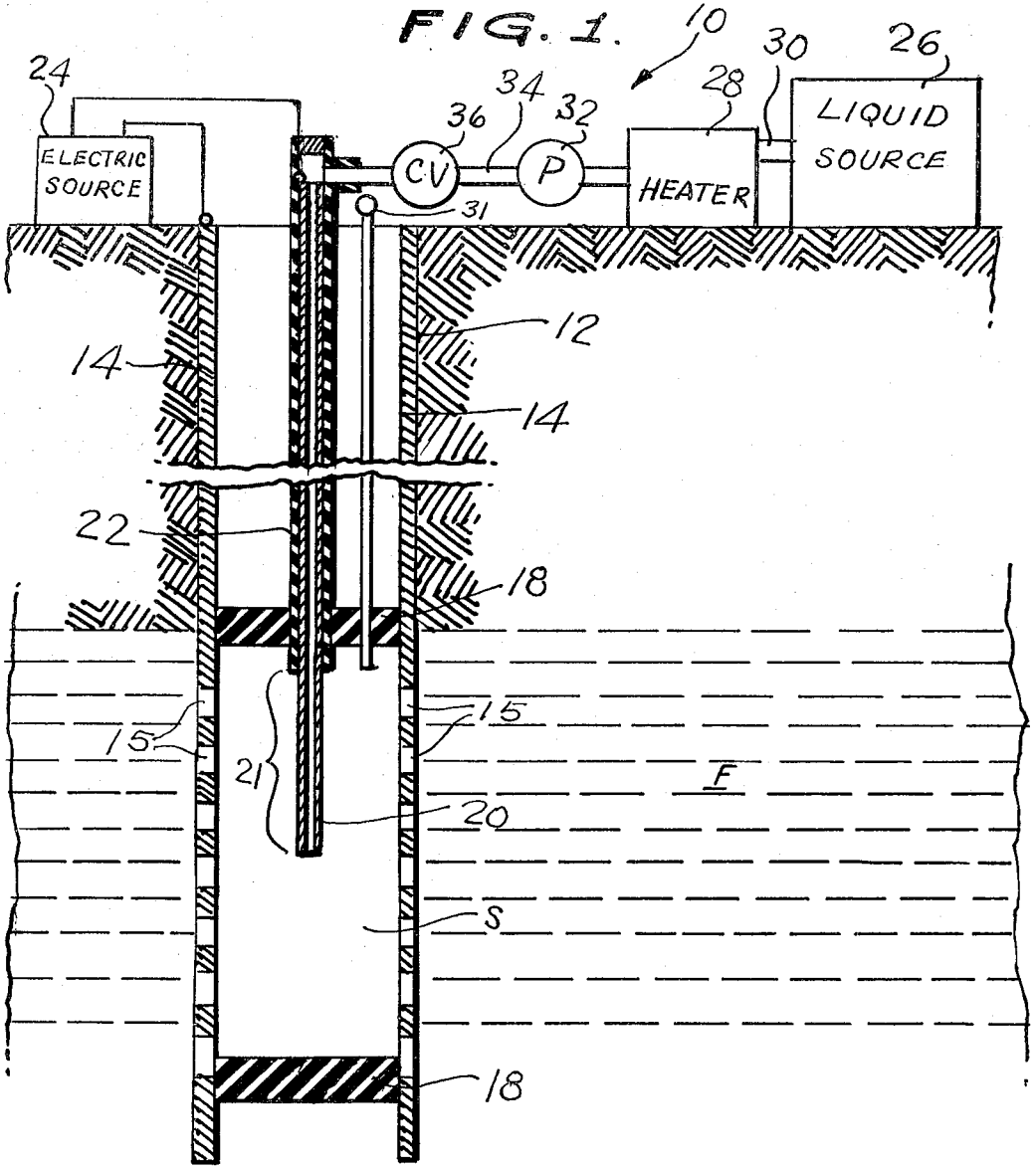
FIGS. 1 and 3 are schematic vertical partially-cross sectional views of two different embodiments of injection wells.

Referring to FIGS. 1 and 2, a first embodiment of the injection well of the present invention is generally designated as 10, and includes a bore hole 12 extending from the ground surface level into or through an oil-bearing earth formation designated by the letter F. A casing 14 is adjacent to and extends along the perimeter of the bore hole 12. Casing 14 is formed of electrically conductive material and extends from the ground surface level to a level at or below the oil-bearing earth formation level. A plurality of perforations or openings 15, typically about half an inch in diameter, are formed in that portion of the casing adjacent the oil-bearing earth formation F.

A pair of spaced apart sealing plugs 18 are disposed within the bore opening 12 to thereby confine a portion of the bore hole 12 therebetween. This defined area between plugs 18 is designated as S. One of the sealing plugs 18 is at an elevation above and the other sealing plug 18 is at an elevation below at least a portion of the oil-bearing earth formation F. The plugs 18 are preferably effective in sealing the defined zone of bore 12 to a pressure in the range of from 400 psi to a pressure in excess of 25,000 psi.

An electrode 20 is disposed within the bore opening 12 and extends from above ground level to a level spaced between the two sealing plugs 18. Electrode 20 is typically made of a good electrically conductive material, such as stainless steel, and in the first embodiment of the present invention it is hollow to accommodate the flow of an electrically conductive liquid therethrough and into the space between the sealing plugs 18.

Surrounding a portion of the electrode 20, as it extends from ground level to some position below the sealing plug 18 of higher elevation, is an insulating sleeve 22. However, at least a portion of the electrode 20 as it extends between the plugs 18 is not covered by the insulating sleeve 22, and is designated as 21.

An electric source 24, typically at the ground level, is in electrical contact with casing 14 at one polarity terminal, and is further in electrical communication with the electrode 20 at the other polarity terminal. The electric-power supply should be able to supply at least 800 amps of current.

A source of the electrically conductive liquid, typically water or brine, is designated as 26 and is in communication with a heater 28 by means of a conduit 30. The heated liquid is pumped from a heater 28 by means of a pump 32 to the hollow electrode 20 by means of conduit 34. A valve 36 is interposed between sections of conduit 34 for the control of the liquid therethrough.

In the operation of the injection well 10 of the present invention, a liquid, for example water, from source 26 is preheated by the heater 28 to a temperature of about 70° to 200° F. Control valve 36 is opened and the water is driven by pump 32 through the conduit 34 and hollow electrode 20 and into the space S defined between the sealing plugs 18. The rate at which the water is pumped depends on the permeability of the formation and the viscosity of the oil held therein. More water can be injected, if needed, at a higher rate or at a lower rate since every oil formation will differ. Also, the water is driven at a pressure which is a function of both the depth of the well and oil-bearing formation. However, as a general rule of thumb, three pounds of pressure is required for each running foot of oil bearing formation depth from ground surface. A pressure sensor means 31, such as a conventional pressure gauge having a member which extends into the space S, is used to read the water pressure therein.

As the water fills the space defined between the plugs 18, an electric current is generated from source 24 to the electrode 20. Since only a portion of the electrode, as it extends between plugs 18, is not covered by the insulating sleeve 22, the current flows therefrom, through the liquid and back through the casing. The liquid, this confined between plugs 18, is heated by the resistive heating of electrode 20.

The liquid is heated to a temperature sufficiently high to vaporize it into steam, i.e., a range of 500° F. to 1000° F. (260° C. to 537° C.). The resulting steam is higher in temperature than the liquid, as well as being of an increased volume over that of the liquid, i.e. a 144 fold increase in volume. It is the combination of the heat of the steam and the increased pressure therefrom which drives the oil from the earth formation F and into a second bore hole 38 from which the oil is pumped by means of a pump 40 into an oil sump 42. Second bore hole 38, like bore 12, includes a casing which includes a plurality of perforations or holes 46 in the area of the oil-bearing formation. Likewise, a pair of spaced apart sealing plugs 48 are disposed within the casing 44, one at an elevation above and another at an elevation below at least a portion of the oil-bearing formation. The oil collected between the sealing plugs 48 is driven upwardly through a conduit 50, which extends therein, to the oil sump 42 by means of pump 40.

It is anticipated by the present invention that the liquid heated by electrode 20 may vaporize either in the space defined by the plugs 18 or in the oil-bearing formation itself.

In the first instance, a sufficient amperage will flow through the electrode 20 to cause the liquid to vaporize into steam directly in the space S.

In the second instance, the liquid is at a sufficiently high pressure such that it will not vaporize even though heated to a temperature which under normal pressure would cause it to convert to steam. However, as the heated liquid flows through the perforations 15, and into the oil-bearing formation F, there is a decrease in the pressure to which the heated liquid is subjected thereby permitting the vaporization of the liquid into steam.

Typically the electric source 24 is a transformer of the three-phase isolation variety having, for example, a primary of 12,500 volts, three phase 60 Hz., 2200 KVA with two isolated secondaries, each of 155 volts, three phase, 700 KVA. To each secondary is permanently connected a saturable reactor for voltage control of approximately 150 volts to 77 volts. Likewise the saturable reactor is permanently connected to a three phase bridge rectifier typically rated for 500 amps and 200 volts. The combination of the transformer, saturable reactor, and rectifier may be connected in series or parallel by means of bus links. These units may operate in either one of two modes. In a first mode, the units are internally in series and externally in parallel to provide an output of 15,000 amps at 400 to 200 volts DC. In a second operating mode, the units are internally in parallel, but externally in series to provide an output of 10,000 amps at 600 to 300 volts DC. The theoretical operating point of the electric source 24 is typically at about 10,000 amps 400 volts DC which may be provided by both modes of operation, however the first mode is for lower than expected resistance of the load, whereas the second mode is for higher than expected resistance.

The design of the electrode 20 and casing 14 typically determines the power requirement. Since the design of these elements includes many factors, it is preferable that the power supply be capable of providing a wide range of voltage and current values. However, higher current and lower voltage are required for the operation of the present invention when large diameter casings and short bore holes are utilized. In contrast, less current and higher voltage is required for smaller casings and/or deep bore holes.

Furthermore, the liquid flow rate, liquid pressure and power level must be kept at corresponding levels. Thus, loss of pressure or loss of liquid flow must be followed by a reduction in the power, otherwise electrode 20 and casing 14 may be burned out, and thereby require their being removed from the bore hole.

Either AC or DC current may be used in operating the present invention. However, DC current is the best source if the present invention is to be adapted to an existing well, since there will be a greater loss of returning DC current in the casing 14 than for AC current. It is possible, if AC current were used in an existing well, that the existing casing could rupture because it may not be able to withstand the current, as the current would be constant in both the electrode 20 and the casing 14.

AC current would be suitable, however, if the casing were of the same material as the electrode, for example, stainless steel, and further if the casing was stretched as it was disposed into the bore hole; otherwise the casing 14 may tend to rise up from the ground due to the heat and current flowing therethrough.

It is apparent from the above discussion that the current capacity of the casing 14 will determine the operating current of the present invention, e.g., less than 15,000 amps DC when the casing is approximately 7 inches in diameter.

In a typical construction of the present invention requiring a bore hole 12 of approximately 1,000 feet (300 m) in length, the casing 14 would have a 7" (17.8 cm) outside diameter and a $5\frac{7}{8}$" (14.98 cm) inside diameter. Furthermore, a typical liquid flow rate for such a construction of the present invention would be about 33 barrels per hour, with a pressure at the top of the bore of a minimum of 3,000 psi (210 kg/cm$^2$) and a preheat liquid temperature of 70° to 200° F. (21.1° C. to 93.3° C.) with 200° F. (93.3° C.) being the preferred temperature. Further, assuming that water is the liquid which will be utilized, in such a construction it would be heated within the space between plugs 18 to a temperature of approximately 680° F. at 3,000 psi (360° C. at 210 kg/cm$^2$). Approximately three megawatts of power would be required to heat the water at this temperature.

Figure 3:
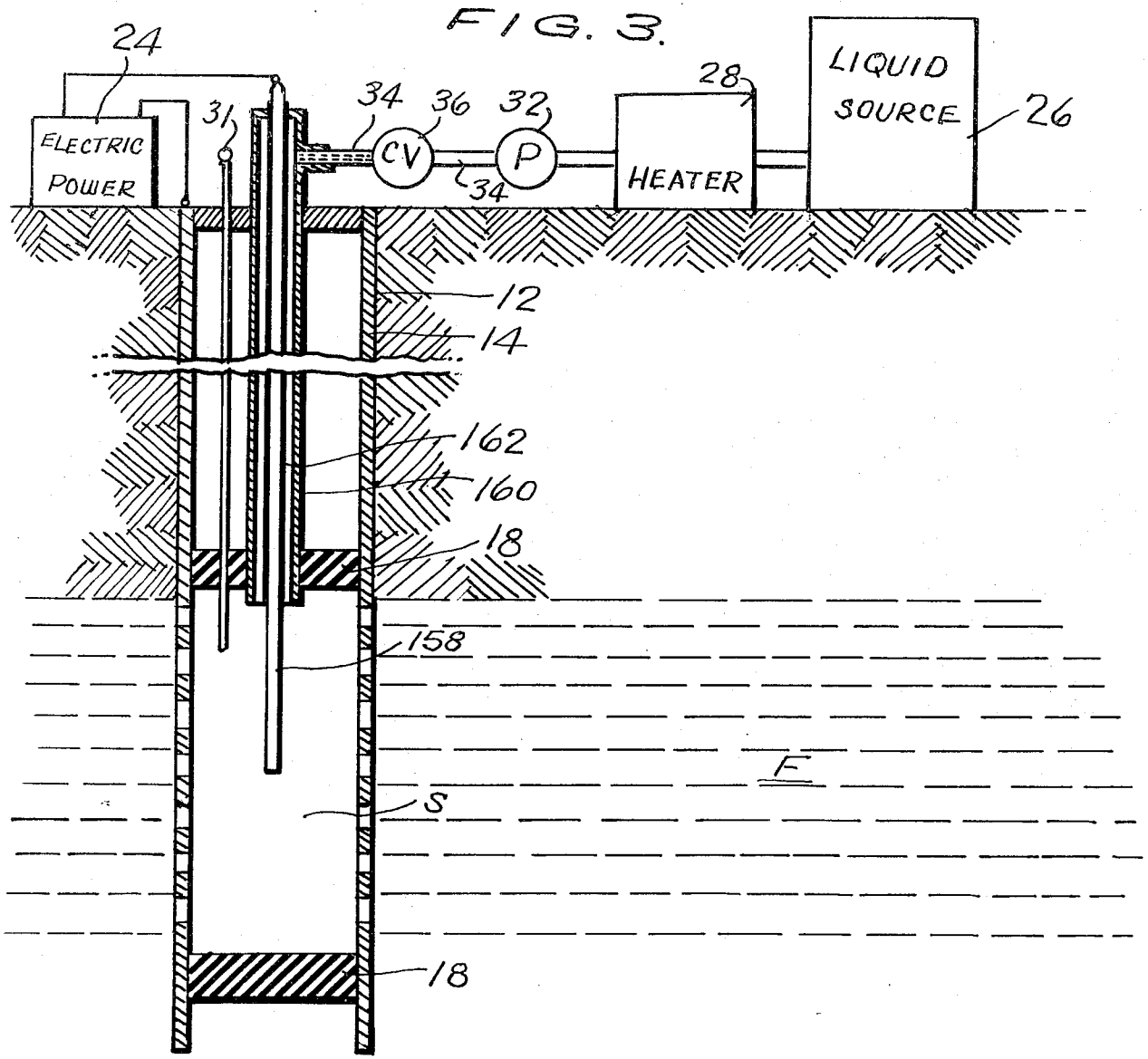

Referring to FIG. 3, in a second embodiment of the present invention many of the features described in the first embodiment are the same, and thus are identified by the same number as shown in FIG. 1. However, the electrode in the second embodiment, designated as 158, is not adapted for the flow of a liquid therethrough. Instead, a tubular member 160 extends in the bore hole 12 from the ground level and through the sealing plug 18 of the highest elevation. Tubular member 160 is in communication with the conduit 34. Electrode 158 is disposed from ground level, downwardly through tubular member 160 and into the space S defined between sealing plugs 18. An insulating sleeve 162 covers the electrode 158 as it extends through the tubular member 160. However, space is provided between the insulating sleeve 162 and the inside diameter of the tubular member 160. It is through this space that the liquid flows from conduit 34 into the space S defined between the sealing plugs 18. As in the first embodiment of the present invention, a portion of the electrode 158, as it extends in the space S between the plugs 18, is not covered by an insulating sleeve, thus providing for the flow of current from the electrode 158 to casing 14.

In other respects the operation of the second embodiment 100 of the present invention is the same as that of the first embodiment 10.

Figure 4:
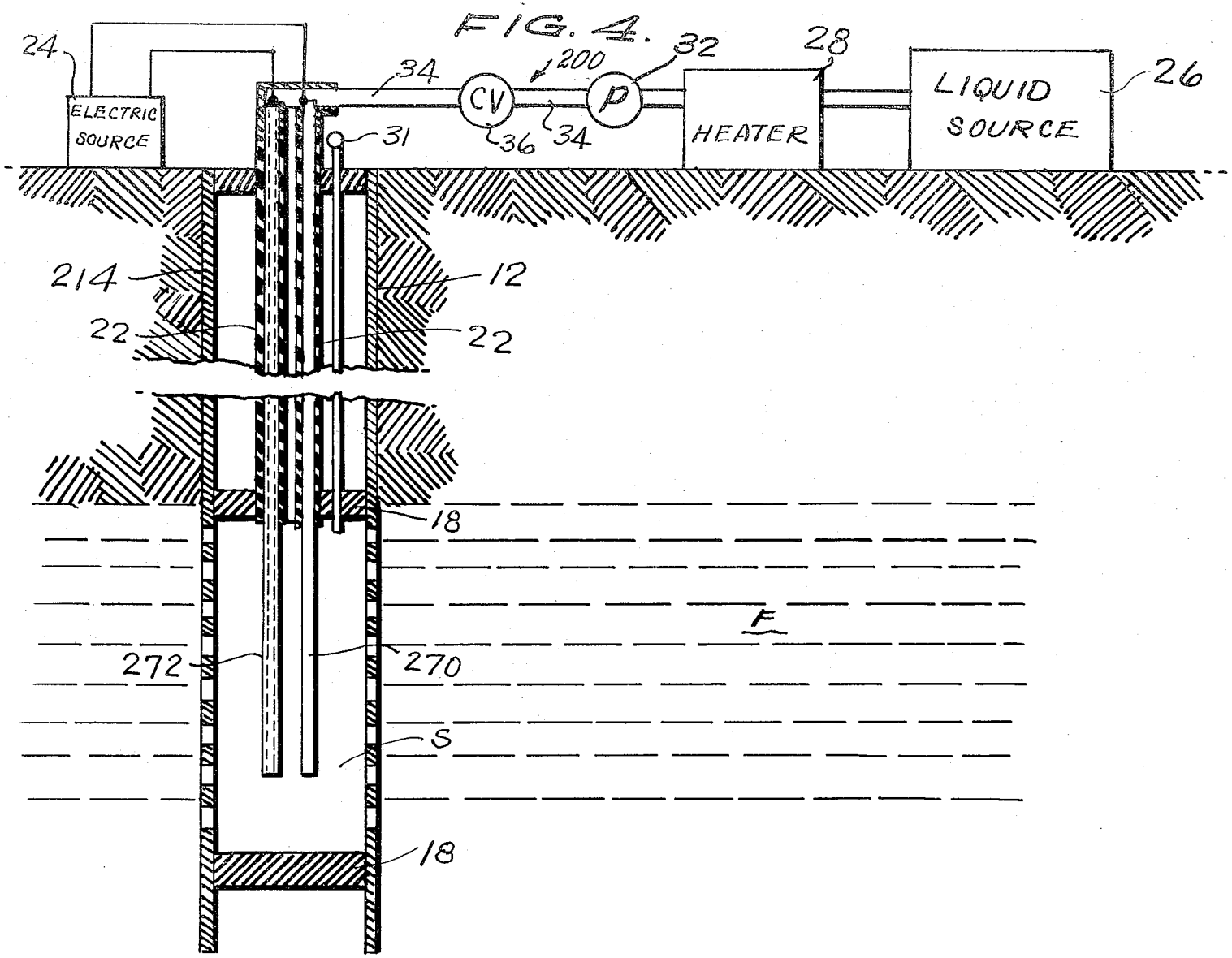
FIG. 4 is a schematic vertical partially-cross sectional view of a third embodiment of the injection well of the present invention.

Referring to FIG. 4, a third embodiment of the present invention is generally designated as 200. The third embodiment has many of the same elements as found in the first and second embodiments, and those same elements will be identified by the same reference number. However, the third embodiment differs in that it includes first and second electrodes 270 and 272, respectively, extending within the bore hole 12. The electrodes 270 and 272 are connected to opposite polarity terminals of the electric power source 24. Electrical insulation sleeve 22 surrounds each of the electrodes as in the other embodiments. Furthermore, the electrodes are of a material which will accommodate either an AC current or a DC current.

Unlike the first and second embodiments, in the operation of the third embodiment, the current flows from the non-insulated portion of one electrode to the non-insulated portion of the other electrode. The resistive heating of the electrodes thereby brings about the heating of the water or brine contained between the two spaced apart plugs 18.

In the third embodiment 200, there is no need for the casing 214 to be constructed of an electrically conductive material, since the two electrodes accommodate the flow of current within the bore hole 12. Thus, this embodiment is the more preferred when one is utilizing AC current. As discussed above, when AC current is utilized through the casing, certain accommodations must be made in order to assure that damage and displacement does not occur to the casing.

Also in the third embodiment, either one or both of the electrodes 270 and 272 may be hollow, to thereby provide for the flow of water or brine from the ground surface into the shape S defined between plugs 18.

Figure 5:
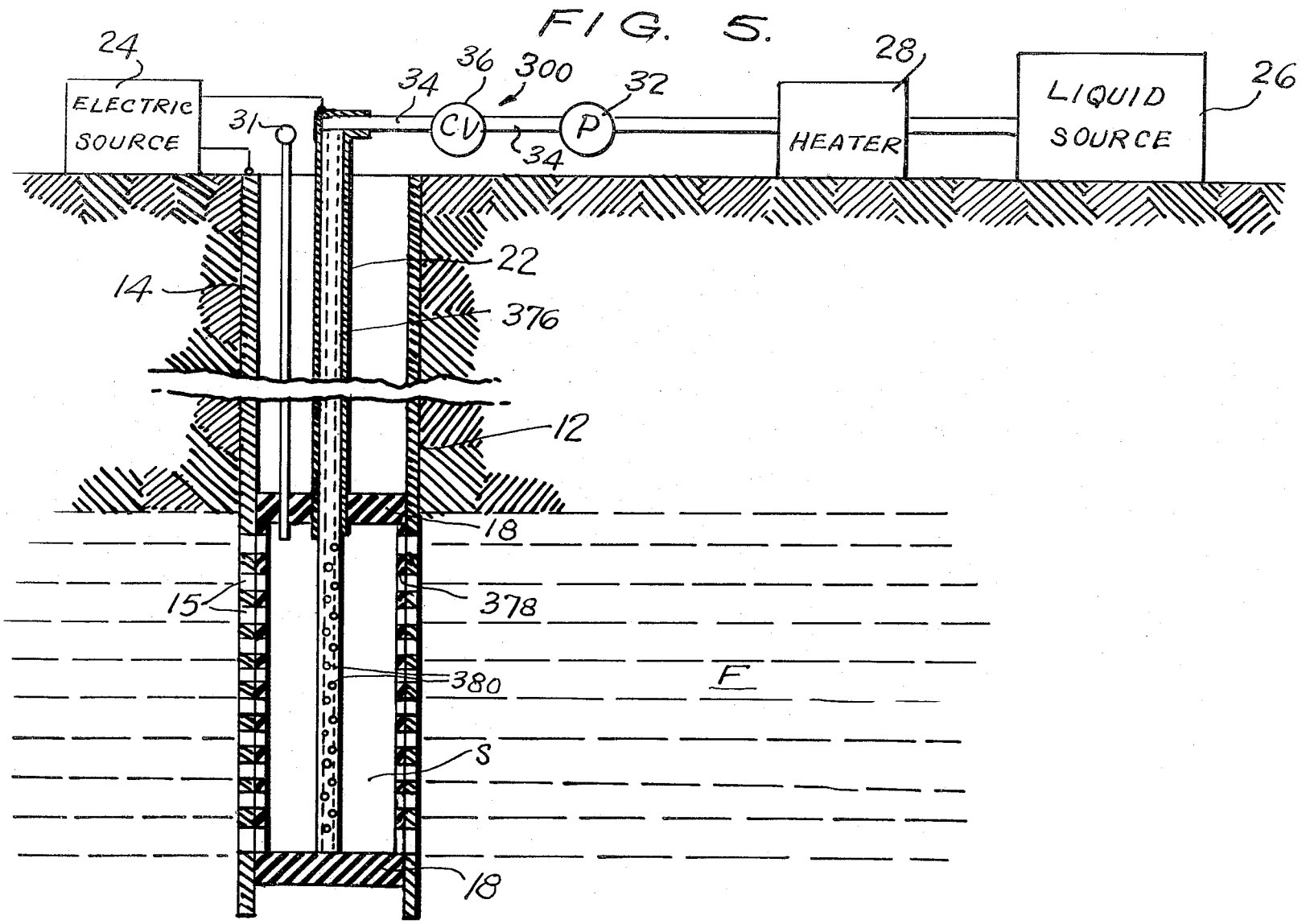
FIG. 5 is a schematic vertically partially-cross-sectional view of a fourth embodiment of the injection well of the present invention.

The fourth embodiment of the present invention, as shown in FIG. 5, is generally designated as 300. All elements of the fourth embodiment 300 which are the same as that in the first embodiment are identified by the same reference number.

In the fourth embodiment 300, a hollow electrode 376 extends from ground level through the plug 18 of highest elevation and down to the second plug 18 of lowest elevation. The lower elevated plug 18 is of an electrically conductive material and in electrical contact with both the electrode 376 and the casing 14, whereas the highest elevated plug 18 is either of an insulating material or electrically insulated from electrode 376. Also, hollow electrode 376 is in communication with conduit 34 for the passage of a liquid therethrough.

An insulating sleeve 378 is internally adjacent the casing 14 as it extends between the two plugs 18, and includes holes in alignment with the holes 15 of casing 14. The casing 14 and electrode 76 are each in electrical contact with opposite polarity terminals of the electric power source 24. Thus, an electrical current will flow through the electrode 376, as it extends from the ground level to the lowest elevated plug 18, through the lowest elevated plug 18, and back to the power source 24 by means of the casing 14. As in the other embodiments of the present invention, the resistive heating of the electrode 376 heats the water or brine contained between the plugs 18.

Furthermore, a plurality of perforations 380 are formed in the electrode 376 as it extends between the plugs 18 to thereby accommodate the flow of water or brine therethrough and into the space S defined between plugs 18.

While this invention has been described with respect to several embodiments, it is not limited thereto. The appended claims therefore are intended to be construed to encompass all forms and embodiments of the invention within its true spirit and full scope, whether or not such forms and embodiments are specifically suggested herein.

What is claimed is:

1. An injection well comprising a bore hole, a casing, sealing means, electrode means, means for conducting liquid, liquid pressure means and electric power supply, the bore hole having a perimeter and extending from ground surface level into or through an oil-bearing earth formation, the casing being an electrically-conductive hollow casing extending along the perimeter of the bore hole from ground surface level to a level at or below the oil-bearing earth formation and having multiple perforations throughout a portion thereof adjacent the oil-bearing earth formation, the sealing means being two spaced-apart high-pressure-resistant plugs sealing the casing, the first such plug being at an elevation above and the second plug being at an elevation below at least a portion of the oil-bearing earth formation, the electrode means comprising means to conduct electrical current into the bore hole from ground surface level through the first plug to a lower extremity in the space between the two plugs, said electrode means being externally electrically insulated from the ground surface level to and including the level of the first plug, but to a level which is significantly higher than the lower extremity, the means for conducting liquid comprising means to supply a liquid at a pressure of at least 400 psi to the space between the two plugs, and the electric-power supply comprising means to produce a current of at least 800 amps between a non-insulated portion of the electrode means in the space between the two plugs and adjacent casing.

2. An injection well according to claim 1 having sensor means to measure pressure in the space between the two plugs.

3. An injection well according to claim 2 wherein the electric-power supply comprises means to induce a direct current.

4. An injection well according to claim 3 wherein the sealing plugs are effective to seal and to maintain the space therebetween under a fluid pressure in the range of from about 400 psi to a pressure in excess of 25,000 psi.

5. An injection well according to claim 4 wherein the liquid pressure means comprises means to supply a liquid at a temperature of about 200° F.

6. An injection well according to claim 2 wherein the liquid pressure means comprises means capable of supplying a surface liquid at a temperature of about 200° F. and under a pressure within the range of from 400 to 25,000 psi, and the sealing plugs are effective to seal and to maintain the pressure induced therebetween.

7. An injection well according to claim 6 wherein the liquid-pressure means comprises means capable of supplying a liquid at a rate of about 33 barrels per hour.

8. An injection well according to claim 6 wherein the electric-power supply comprises means to induce flow of direct current through the electrode and the non-insulated portion thereof to adjacent casing.

9. An injection well according to claim 6 wherein the electric-power supply comprises means to induce flow of alternating current through the electrode and the non-insulated portion thereof to adjacent casing, both electrode and casing being of a material capable of carrying an alternating current.

10. An injection well according to claim 9 wherein the casing is stretched as disposed within the bore hole, to thereby prevent displacement of the casing upon the flow of an AC current and its accompanying generated heat through the casing.

11. An injection well according to claim 6 wherein the liquid-pressure means comprises means for supplying a liquid at a pressure of at least 400 psi.

12. An injection well according to claim 6 wherein the electric-power supply comprises means for heating said liquid under pressure in the space between said sealing plugs to a degree such that said liquid as it is forced into said oil-bearing earth formation is subjected to a decrease in pressure and thereupon vaporizes into steam.

13. An injection well according to claim 12 wherein the liquid is heated in a range of from about 500° F. to 1,000° F.

14. An injection well according to claim 6 wherein the electric-power supply comprises means for heating said liquid so that it is vaporized into steam in the space between the sealing plugs.

15. A combination of at least two wells having an oil-bearing earth formation therebetween, one of the wells being an injection well according to claim 1.

16. An injection well according to claim 1 wherein said liquid is water.

17. An injection well according to claim 1 wherein said liquid is brine.

18. An injection well according to claim 1 wherein said liquid is electrically conductive.

19. An injection well according to claim 1 wherein said electrode means is hollow and adapted to accommodate the passage of the liquid therethrough and into the space between the two plugs.

20. An injection well according to claim 1 further comprising a tube member extending into the bore hole from ground level to a level at least through the first plug, the electrode means is disposed within the tube member and spacing between the tube member and the electrode means is adapted to accommodate the passage of liquid into the space between the two plugs.

21. An injection well comprising a bore hole, a casing, sealing means, a pair of electrode means, liquid conduit means, liquid pressure means and electric power supply, the bore hole having a perimeter and extending from ground surface level into or through an oil-bearing earth formation, the casing being hollow and extending along the perimeter of the bore hole from ground surface level to a level at or below the oil-bearing earth formation and having multiple perforations throughout a portion thereof adjacent the oil-bearing earth formation, the sealing means being two spaced-apart high-pressure-resistant plugs sealing the casing, the first such plug being at an elevation above and the second such plug being at an elevation below at least a portion of the oil-bearing earth formation, the electrode means comprising means to conduct an electrical current into and out of the bore hole from ground level through the first plug and to a lower extremity in the space between the two plugs, said electrode means being externally electrically insulated from the ground surface level to and including the level of the first plug, but to a level which is significantly higher than the lower extremity.

the means for conducting liquid comprising means to conduct a liquid from the ground surface level through the first plug and into the space between the two plugs, the liquid pressure means comprising means to supply a liquid at a pressure of at least 400 psi to the space between the two plugs, and the electric-power supply comprising means to produce a current of at least 800 amps through the non-insulated portion of the electrode means.

22. An injection well according to claim 21 wherein the electrode means comprises a pair of electrodes spaced-apart as they are disposed into the bore hole, each of the electrodes being in electrical contact with opposite polarities of said power supply, the electrodes are adapted so that an electrical current can flow from the non-insulated portion of one electrode to the non-insulated portion of the other electrode.

23. An injection well according to claim 22 wherein the pair of electrodes are adapted to accommodate the flow of an AC current therethrough.

24. An injection well according to claim 22 wherein the pair of electrodes are adapted to accommodate the flow of a DC current therethrough.

25. An injection well according to claim 22 wherein at least one of said electrodes is hollow and adapted to accommodate the passage of the liquid therethrough and into the space between the two plugs.

26. An injection well according to claim 1 wherein said power supply is a three phase isolation transformer having a primary and two secondary coils with each secondary coil electrically connected to a saturable reactor and each reactor electrically connected to a three phase bridge rectifier.

27. An injection well according to claim 1 wherein said power supply is adapted to generate an output of at least 10,000 amps at 300 to 600 volts DC.

28. An injection well comprising a bore hole, a casing, sealing means, electrode means, liquid conduit means, liquid pressure means and electric power supply.

the bore hole having a perimeter and extending from ground surface level into or through an oil-bearing earth formation, the casing being an electrically-conductive hollow casing extending along the perimeter of the bore hole from ground surface level to a level at or below the oil-bearing earth formation and having multiple perforations throughout a portion thereof adjacent the oil-bearing earth formation, the sealing means being two spaced-apart high-pressure-resistant plugs sealing the casing, the first such plug being at an elevation above and the second such plug being at an elevation below at least a portion of the oil-bearing earth formation, said second plug being electrically conductive and said casing being in electrical contact therewith, the electrode means comprising means to conduct electrical current into the bore hole from ground surface level through the first plug and to the second plugs, said electrode means being externally electrically insulated from the ground surface level to and including the level of the first plug, said electrode in electrical contact with said second plug, an electrical insulation sleeve internally adjacent the casing as it extends between the first and second plugs, and electrically insulating the casing from the non-insulated portion of said electrode, the liquid conduit means comprising means to conduct a liquid from the ground surface level through the first plug and into the space between the two plugs, the liquid pressure means comprising means to supply a liquid at a pressure of at least 400 psi to the space between the two plugs, and the electric-power supply comprising means to produce a current of at least 800 amps through the electrode means to the second plug and to the casing.

29. An injection well according to claim 28 wherein said electrode means is hollow and comprises a plurality of perforations as it extends between the plugs to accommodate the flow of the liquid through the electrode means and into the space between the plugs.

30. A process for extracting oil from an underground oil-bearing earth formation which comprises:

continuously charging liquid through tubing and under a pressure within a range of from 400 to 25,000 psi into a well to a level within the oil-bearing earth formation, and passing sufficient electrical current through said tubing, through liquid at the level within the oil-bearing earth formation and through casing for the well to heat said tubing by induction and to heat the liquid to a temperature in the range of 500° F. to 1000° F. (260° C. to 537° C.) at said level under prevailing pressure.

31. A process according to claim 30 which comprises charging the liquid continuously at a substantially sustained rate.

32. A process according to claim 31 wherein the rate is about 33 barrels per hour.

33. A process according to claim 30 which comprises preheating the liquid on the surface to about 200° F. prior to charging it into the well.

34. A process according to claim 33 wherein the charging is effected at a substantially sustained rate in the range of from 25 to 45 barrels of the liquid per hour, the pressure under which the liquid is maintained in the well is at least 400 psi, and the current passing through the tubing or casing is substantially that required to super heat said liquid at its rate of charge under prevailing pressure.

35. A process according to claim 34 wherein the liquid charged into the well is heated to a temperature of about 680° F.

36. A process according to claim 34 which comprises charging the preheated liquid into the well at a rate of about 33 barrels per hour, maintaining said liquid in the well under a minimum pressure of at least 400 psi and passing sufficient direct current through the casing and the tubing at the oil-bearing-earth-formation level to super heat said liquid at substantially its rate of charge.

37. A process for extracting oil from an underground oil-bearing formation which comprises:

continuously heating an electrically conductive liquid on the surface to about 200° F.;

continuously charging the liquid through tubing and under a pressure within a range of from 400 to 25,000 psi into a well to a level within the oil-bearing earth formation, and passing sufficient electrical current through the tubing, through the liquid at the level within the oil-bearing earth formation and through casing for the well to heat said tubing by induction and to heat the liquid to a temperature in the range of 500° F. to 1000° F. (200° C. to 537° C.) at said level under prevailing pressure.

* * * * *